US006532659B1

(12) United States Patent
DeSousa et al.

(10) Patent No.: US 6,532,659 B1
(45) Date of Patent: Mar. 18, 2003

(54) METHOD OF FORMING A GAS TREATMENT DEVICE USING A STUFFING CONE APPARATUS

(75) Inventors: Egas J. DeSousa, Grande Blanc, MI (US); John C. Boehnke, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/996,455

(22) Filed: Nov. 29, 2001

(51) Int. Cl.[7] ..... B23P 15/00
(52) U.S. Cl. ..... 29/890; 29/525
(58) Field of Search ..... 29/890, 525, 428, 29/896.62

(56) References Cited

U.S. PATENT DOCUMENTS

| | | | | | |
|---|---|---|---|---|---|
| 4,093,423 | A | * | 6/1978 | Neumann | 29/213.1 |
| 4,148,120 | A | * | 4/1979 | Siebels | 138/149 |
| 5,557,847 | A | * | 9/1996 | Koshiba et al. | 29/446 |
| 5,724,735 | A | * | 3/1998 | Ickes et al. | 29/515 |
| 5,862,590 | A | * | 1/1999 | Sakashita et al. | 29/446 |
| 6,113,864 | A | * | 9/2000 | Kueper et al. | 29/890 |
| 6,145,195 | A | * | 11/2000 | Wieres | 29/505 |
| 6,389,693 | B1 | * | 5/2002 | Aranda et al. | 29/407.05 |
| 2002/0096225 | A1 | * | 7/2002 | Ishizu et al. | 138/114 |
| 2002/0124403 | A1 | * | 9/2002 | Eisenstock | 29/890 |

* cited by examiner

*Primary Examiner*—I Cuda Rosenbaum
(74) *Attorney, Agent, or Firm*—Vincent A. Cichosz

(57) ABSTRACT

The present disclosure relates to a stuffing cone apparatus, method for making a gas treatment device, and the device made therefrom. In one embodiment, the stuffing cone apparatus comprises: a funnel having a first end and a second end, with the second end having a smaller diameter than the first end, a pusher detail comprising a pusher disc perpendicularly disposed on an end of a pusher arm, wherein the pusher detail is slideable within the funnel, and a retainer detail comprising a retainer disc perpendicularly disposed to an end of a retainer arm, wherein the retainer detail is slideable within the funnel. The retainer disc and the pusher disc are capable of physically contacting opposite sides of a substrate within the funnel.

The method for forming a gas treatment device comprises: disposing the housing at a locating cavity positioned near a second end of a funnel, wrapping a substrate with a mat support material to form a subassembly, disposing a pusher disc in physical contact with a subassembly first side, and disposing a retainer disc of a retainer detail in physical contact with a subassembly second side, wherein the retainer detail extends through the second end of the funnel toward a first end of the funnel to engage the subassembly second side. Sufficient force is applied on the subassembly with the pusher detail to slidably move the subassembly toward the second end, and an opposite and lesser force is applied on the subassembly with the retainer detail. The subassembly is moved from the funnel into the housing to form the gas treatment device.

5 Claims, 1 Drawing Sheet

METHOD OF FORMING A GAS TREATMENT DEVICE USING A STUFFING CONE APPARATUS

BACKGROUND OF THE INVENTION

Gas, e.g., exhaust gas, treatment devices such as catalytic converters, evaporative emissions devices, hydrocarbon scrubbing devices, diesel particulate traps, non-thermal plasma reactors, and the like, are employed in various applications to physically and/or catalytically treat environmentally unfriendly gas emissions. Such gas treatment devices incorporate a substrate, support, monolith, or brick, which includes a catalyst material coated thereon. A mounting device such as a mat support material comprising an intumescent material, non-intumescent material, or a combination of both, is disposed about the substrate forming a mat support material/substrate subassembly, prior to being inserted into the gas treatment device's housing.

One method for inserting the mat support material/substrate subassembly into the housing comprises using a stuffing cone. In this method, the outlet of the stuffing cone, which is disposed adjacent to the inlet of the housing, has an inner diameter less than the inner diameter of the housing. As the mat support material/substrate subassembly moves through the stuffing cone toward the housing, the stuffing cone compresses the mat support material about the substrate so that the subassembly can be disposed into the housing. More particularly, as the mat support material/substrate subassembly slides against the inwardly tapered interior of the stuffing cone, the mat support material compresses about the substrate until the mat support material substrate subassembly has an outer diameter less than the housing outer diameter. At this point, the mat support material/substrate subassembly is pushed into the housing.

Generally, the stuffing cone's diameter is less than the diameter of the smallest housing to be stuffed using that particular stuffing cone to ensure the subassembly is sufficiently compressed to be inserted into the housing. In some cases, the stuffing cone overly compresses the mat support (e.g., the housing inner diameter is substantially larger than the stuffing cone inner diameter. This design causes the mat support material to exert excessive force about the substrate. In contrast, it is predicted that the housing exerts a greatly reduced level of pressure per square inch about the subassembly to retain it in place after disposal. The additional pressure exerted during the subassembly's compression in the stuffing cone reduces the mat support material's retentive capabilities, increases the over compression of the mat support material, and increases the probability of substrate breakage.

Also, in order to effectively stuff the matted substrate into the housing, the housing must be sized to the desired mat density level following the low-pressure stuffing operation. This process is limiting, however, in that it is not suitable for non-rounded substrates or material with excessive spring back properties.

SUMMARY OF THE INVENTION

The present disclosure relates to embodiments of a stuffing apparatus, a method for forming a gas treatment device or similar device, and the device formed thereby. The method for forming a gas treatment device comprises: disposing the housing at a locating cavity positioned near a second end of a funnel, wrapping a substrate with a mat support material to form a subassembly, disposing a pusher disc in physical contact with a subassembly first side, and disposing a retainer disc of a retainer detail in physical contact with a subassembly second side, wherein the retainer detail extends through the second end of the funnel toward a first end of the funnel to engage the subassembly second side. Sufficient force is applied on the subassembly with the pusher detail to slidably move the subassembly toward the second end, and an opposite and lesser force is applied on the subassembly with the retainer detail. The subassembly is moved from the funnel into the housing to form the gas treatment device.

In one embodiment, the stuffing cone apparatus comprises: a funnel having a first end and a second end, with the second end having a smaller diameter than the first end, a pusher detail comprising a pusher disc perpendicularly disposed on an end of a pusher arm, wherein the pusher detail is slideable within the funnel, and a retainer detail comprising a retainer disc perpendicularly disposed to an end of a retainer arm, wherein the retainer detail is slideable within the funnel. The retainer disc and the pusher disc are capable of physically contacting opposite sides of a substrate within the funnel.

In another embodiment, the stuffing cone apparatus comprises a means for compressing a mat support material about a substrate, a means for physically contact with a subassembly first side, and a means for physically contacting a subassembly second side. The means for physically contacting a subassembly second side is capable of extending through a second end of the means for compressing a mat support material about a substrate toward a first end of the means for compressing a mat support material about a substrate to engage the subassembly second side.

The above-described and other features will be appreciated and understood by those skilled in the art from the following detailed description, drawings, and appended claims.

BRIEF DESCRIPTION OF THE DRAWINGS

Referring now to the figures wherein the like elements are numbered alike.

DESCRIPTION OF THE PREFERRED EMBODIMENT

Figure 1:
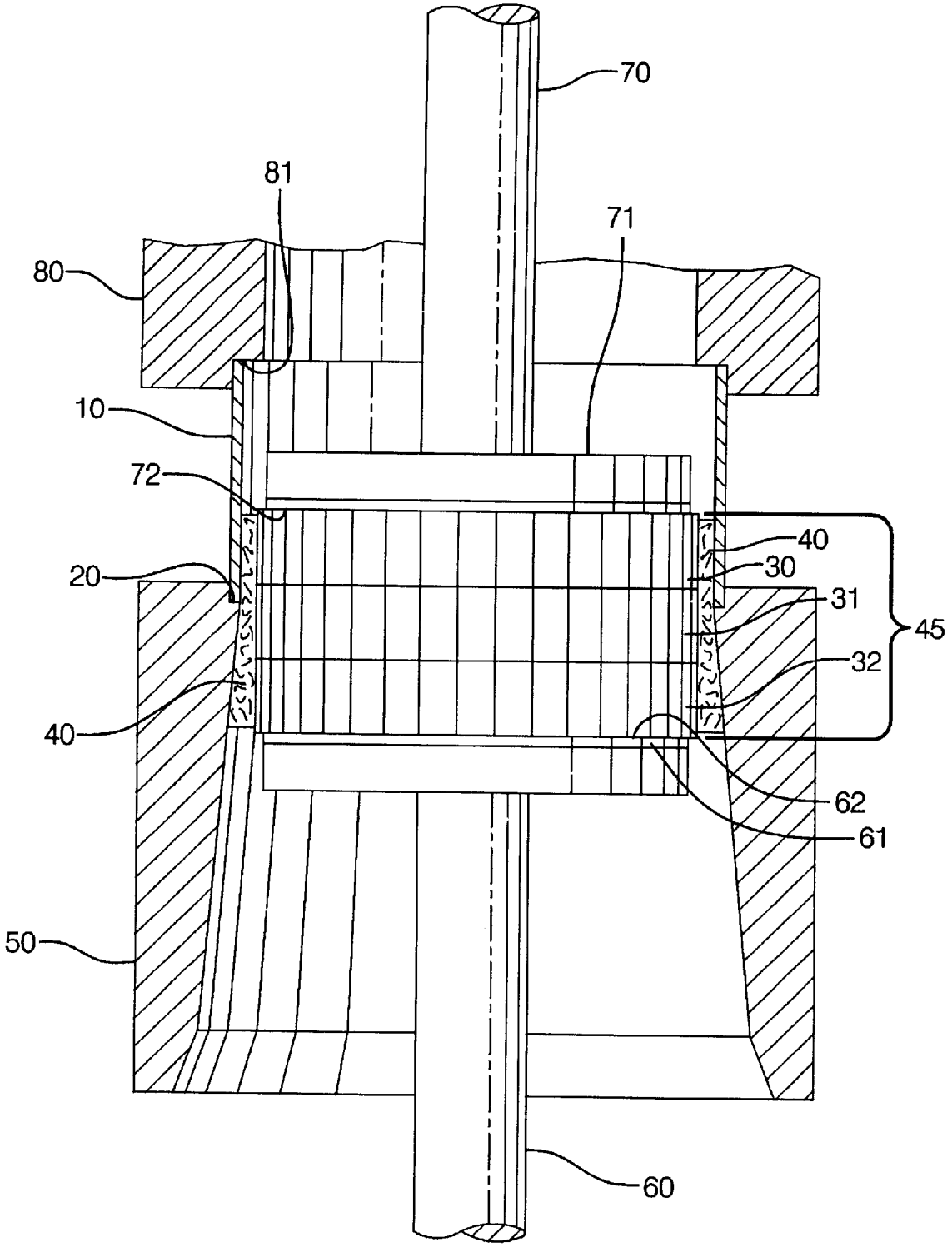
FIG. 1 is a cross-sectional view of a stuffing cone attached to a housing and depicting the movement of the matted substrate into the housing by way of the stuffing cone.

A stuffing cone apparatus, a method for producing a gas treatment device, and the device formed thereby are disclosed. This gas treatment device formation method allows for both variability in the substrate geometry and the properties exhibited by the supporting mat.

The stuffing cone apparatus comprises a funnel, a pusher detail and a retainer detail. The funnel comprises a conduit with an interior tapered inwardly from a first end toward an opposing second end. The first end comprises a diameter large enough to accept a mat support material/substrate subassembly. The opposing second end comprises a diameter that is less than or equal to the internal diameter of the main body of a housing, which is used to house the mat support material/substrate subassembly after placement therein by the stuffing cone apparatus. Optionally, the second end can comprise a portion having a substantially consistent diameter (e.g., a cylindrical portion, or the like). Additionally, the funnel preferably comprises a locating cavity disposed towards the second end of the funnel for the placement of the housing.

The funnel can possess a cross-sectional geometry such as rounded (e.g., round, oval, elliptical, irregular, and the like), polygonal (e.g., triangular, square, trapezoidal, pentagonal, hexagonal, heptagonal, octagonal, and the like, as well as combinations comprising at least one of the foregoing polygonal shapes), and the like, as well as combinations comprising at least one of the foregoing geometries. With respect to the overall shape, it can be a hollow, elongated geometry capable of receiving the subassembly, compressing the mat support about the substrate as the subassembly moves through the stuffing cone, and introducing the compressed subassembly to the housing. Some possible overall geometries include cylindrical, tubular, conical, and the like, with a truncated conical shape, or a combination of conical and cylindrical shapes preferred.

Disposed at the first end of the stuffing cone is a pusher detail comprising an arm, a disc, and an optional contact detail. The pusher detail is designed to slideably engage the first surface of the mat support material/substrate subassembly, and force it through the stuffer funnel into the housing. Consequently, the pusher detail preferably has a main face with a geometry compatible with the area of the mat support material/substrate subassembly with which it will make contact. For example, the mat support material/substrate subassembly first surface can be flat, and the pusher detail can have a disc with a flat main face.

In order to compensate for mat support material/substrate subassembly first surface irregularities, a contact detail may be disposed on the main face. The contact detail can comprise a compliant material, such as an elastomer (e.g., rubber, or the like), that is capable of conforming to the substrate surface upon main face engagement.

Disposed perpendicular to a surface opposite the main surface is an arm or rod that connects to the disc to form a "T", plunger, piston, or the like. The pusher detail is preferably designed to exert substantially uniform pressure across the mat support material/substrate subassembly first surface.

Disposed at an opposite end of the stuffing cone apparatus, i.e., at the end of lesser diameter, is a retainer detail, e.g., the retainer detail can optionally be a mirror of the pusher detail, disposed on an opposite side of the mat support material/substrate subassembly. Consequently, the retainer detail comprises disc disposed on the end of an arm to form a "T", plunger, piston, or the like. As with the pusher detail, the retainer detail can comprise various sizes and geometries as described above. The retainer detail provides structural integrity to the mat support material/substrate subassembly as it is forced through the stuffing cone into the housing. Consequently, the retainer detail's size and geometer are preferably based upon the structural integrity and geometry of the second surface of the mat support material/substrate subassembly that engages the retainer detail. As with the pusher detail, the retainer detail can employ a compliant material on the surface that engages the mat support material/substrate subassembly.

Referring to FIG. 1, the pusher detail 60 and the retainer detail 70 are preferably dimensioned such that the squareness of the substrate face to the axis of travel is maintained during the stuffing operation. The mat support material 40 is disposed about the substrate(s) 30/31/32 to form a mat support material/substrate subassembly 45. This subassembly 45 is disposed in physical contact with both the pusher detail main face 62 and the retainer detail main face 72. Disposed at the end of the stuffing cone having the smaller diameter, in operable communication with the pusher and retainer details and in physical contact with the locating cavity 20, is an end of the housing 10. As the pusher retainer applies pressure to the mat support material/substrate subassembly in the direction of the interior of the housing, the retainer detail applies a lower, opposite force to the mat support material/substrate subassembly.

During use, the housing 10 is placed in the locating cavity 20 in the funnel 50. Three substrates 30, 31, 32 wrapped in mat 40 form the subassembly 45 that is placed in physical contact with the pusher detail 60 and the retainer detail 70. At this point, the retainer detail is disposed through the housing 10, the funnel 50, and near the end 55. The retainer compliant material 71 is in physical contact with one surface of the subassembly 45, while an opposite surface of the subassembly 45 engages the pusher compliant material 61. As the pusher detail applies a sufficient amount of force to the subassembly 45 to force the subassembly 45 through the funnel 50 while compressing the mat support material 40 about the substrates 30/31/32, the retainer detail applies a second lesser force to the subassembly 45 to maintain a main axis of the subassembly 45 parallel with the axis of travel through the funnel 50, and to maintain multiple substrates 30/31/32 in physical contact with one another. Essentially, the combination of the pusher detail 60 and the retainer detail 70 are employed to guide the subassembly 45 through the funnel 50 and into the housing 10 without allowing the substrates 30/31/32 to separate, turn, jam in the funnel, or otherwise inhibit the stuffing process. As the subassembly 45 is being pushed through the funnel 50 into the housing 10 said funnel 50 along with said housing 10 moves up against opposing springs till the backup plate 80 supports it. Once the subassembly 45 has passed from the funnel 50 into the housing 10, the pusher detail 60 retracts back through the funnel 50 and the retainer detail retracts in the opposite direction, out of the housing 10. Also the funnel 50 returns, e.g., via spring action, to the original position allowing the stuffed housing assembly to be unloaded. The stuffed housing can then be further processed accordingly.

In order to accommodate unusual substrate and housing designs, the retainer detail and/or the pusher detail can be designed to articulate such that one or more substrates, e.g., if several substrates are employed, can be moved at an angle other than parallel to the major axis of the funnel in order to progress through an irregularly shaped housing. Such housings may be useful in a close-coupled or manifold location.

Alternatively, the pusher detail 60 can be stationary. In this embodiment, the catalyst and mat subassembly 45 is placed adjacent to the pusher compliant material 61. The housing 10 is placed in the retaining cavity 21 and the plate 80 is lowered to retain the housing in cavity 81. The retainer detail 70, with the retainer compliant material 71, is then lowered in place to hold the subassembly 45 during the stuffing operation. The funnel 50, and the backup plate 80, with the housing 10 in place, are then pushed down until the subassembly 45 is precisely entered into the housing 10. Limit sensors can be used to control the position of the subassembly 45 with respect to the housing 10 in the end state.

Further processing can comprise sizing of the housing and/or attaching or forming end portions of the housing. The end portions can include end cone(s), end plate(s), manifold (s), and the like, as well as combinations of these end portions. Meanwhile, forming and attachment can comprise spin forming, molding, welding, bonding, and the like, as well as combinations of these methods.

This stuffing cone apparatus can be employed with numerous types and designs of substrates, mat support materials, and housings. For example, the substrate can comprise any material designed for use in a spark ignition or diesel engine environment, and which has the following characteristics: (1) capable of operating at temperatures up to, and exceeding, about 1,000° C. (depending upon the location of the treatment device; e.g., under-floor, close coupled, in the manifold, and the like); (2) capable of withstanding exposure to hydrocarbons, nitrogen oxides, carbon monoxide, carbon dioxide, sulfur, particulates, and/or sulfur oxides; and, if desired, (3) having sufficient surface area and structural integrity to support the desired catalyst. Some possible materials include cordierite, silicon carbide, metal, metal oxides (e.g., alumina, and the like), glasses, and the like, and combinations comprising at least one of the foregoing materials. Some ceramic materials include "HONEY CERAM", commercially available from NGK-Locke, Inc, Southfield, Michigan, and "CELCOR", commercially available from Coming, Inc., Corning, New York. These materials can be in the form of foils, porous structures (e.g., porous glasses, sponges), monoliths (e.g., a honeycomb structure, and the like), and the like, as well as combinations comprising at least one of the foregoing forms.

Disposed on and/or throughout the substrate is optionally a catalyst capable of reducing the concentration of at least one component in the gas. The catalyst may comprise one or more catalyst materials that are wash coated, imbibed, impregnated, physisorbed, chemisorbed, precipitated, or otherwise applied to the catalyst substrate. Possible catalyst materials include metals, such as platinum, palladium, rhodium, iridium, osmium, ruthenium, tantalum, zirconium, yttrium, cerium, nickel, copper, and the like, as well as oxides, alloys, and combinations comprising at least one of the foregoing catalyst materials, and other catalysts.

Disposed around the substrate is the mat support material that can comprise an intumescent material (e.g., comprising a vermiculite component), a nonintumescent material, or combinations thereof. The intumescent material, for example, is one which comprises ceramic materials, and other materials such as organic binders and the like, or combinations comprising at least one of the foregoing materials. The vermiculite component is a component that expands with heating to maintain firm uniform compression, or non-uniform compression, if desired. The non-intumescent material, for example, is one that does not contain vermiculite. Non-intumescent materials include materials such as 900HT, 1100HT, and those sold under the trademarks "NEXTEL" and "SAFFIL" by the "3M" Company, Minneapolis, Minn., or those sold under the trademark, "FIBERFRAX" and "CC-MAX" by the Unifrax Co., Niagara Falls, N.Y., and the like. Intumescent materials include materials, sold under the trademark "INTERAM" by the "3M" Company, Minneapolis, Minn., such as Interam 100, as well as those intumescents which are also sold under the aforementioned "FIBERFRAX" trademark by the Unifrax Co., Niagara Falls, N.Y., as well as combinations comprising at least one of the foregoing materials, and others.

Additionally, the housing can be any material and design appropriate for use with the particular substrate geometry, size, and material. The housing is preferably designed to receive the mat support material/substrate subassembly and withstand the particular operating condition (e.g., close coupled, under floor, and the like). Due to the flexibility and structural integrity provided by the dual details (pusher and retainer), non-symmetrical, complex, cross-sectional geometries may be employed. Additionally, several substrates can be employed. For example, several substrates can replace a single substrate, thereby enabling the use of different substrate and/or catalyst material in different areas of the housing. The substrates can be disposed in series, as shown in FIG. 1, or in parallel.

The stuffing cone apparatus and the method of assembling a gas treatment device, possess several advantages including reduced manufacturing costs. Manufacturing costs will be reduced using the stuffing cone with a retainer detail due to a reduction in substrate breakage. The supportive and stabilizing force exerted by the retainer detail reduces and/or eliminates the probability that the substrate will break. Additionally, due to the enhanced control over the stuffing of the mat support material/substrate subassembly into the housing, irregular substrate and housing geometries can be employed. In order to reduce mat material compression rates during the stuffing process, funnels with smaller gradients or even two stage (two different gradients) can be used.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for forming a gas treatment device, comprising:

disposing a housing at a locating cavity positioned near a second end of a funnel;

wrapping a substrate with a mat support material to form a subassembly;

disposing a pusher disc in physical contact with a subassembly first side;

disposing a retainer disc of a retainer detail in physical contact with a subassembly second side, wherein the retainer detail extends through the second end of the funnel toward a fist end of the funnel to engage the subassembly second side;

applying sufficient force on the subassembly with the pusher detail to slidably move the subassembly through the funnel toward the second end;

applying an opposite and lesser force on the subassembly with the retainer detail; and moving the subassembly from the funnel into the housing to form the gas treatment device.

2. The method of claim 1, wherein the gas treatment device is selected from the group consisting of a catalytic converter, an evaporative emissions device, a hydrocarbon scrubbing device, and a diesel particulate trap.

3. The method of claim 1, further comprising disposing a catalyst on said substrate.

4. The method of claim 1, wherein the housing has an irregular geometry.

5. A gas treatment device formed by the method of claim 1.

* * * * *